8-107 SR
FIP8309 OR 4,400,173

United States Patent [19]
Beavan

[11] 4,400,173
[45] Aug. 23, 1983

[54] BLEACH COMPOSITION CONTAINING WEAKLY TO NON-COLORED PORPHINE PHOTO-ACTIVATOR

[75] Inventor: Stuart W. Beavan, Birkenhead, England

[73] Assignee: Lever Brothers Company, New York, N.Y.

[21] Appl. No.: 331,508

[22] Filed: Dec. 16, 1981

[30] Foreign Application Priority Data

Dec. 22, 1980 [GB] United Kingdom ..... 8040973

[51] Int. Cl.[3] ..... C11D 3/39; D06L 3/04
[52] U.S. Cl. ..... 8/107; 8/101; 8/103; 252/8.6; 252/95; 260/245.72; 260/245.85; 260/245.86
[58] Field of Search ..... 8/107, 103; 252/8.6, 252/95

[56] References Cited

U.S. PATENT DOCUMENTS

| | | | |
|---|---|---|---|
| 3,927,967 | 12/1975 | Speakman | 8/103 |
| 3,927,967 | 12/1975 | Speakman | 8/103 |
| 4,033,718 | 7/1977 | Holcombe et al. | 8/103 |
| 4,077,768 | 3/1978 | Johnston et al. | 8/107 |
| 4,166,718 | 9/1979 | Reinert et al. | 8/111 |
| 4,217,105 | 8/1980 | Goodman | 8/111 |
| 4,240,920 | 12/1980 | de Luque | 252/99 |
| 4,255,273 | 3/1981 | Sakkab | 252/99 |
| 4,256,597 | 3/1981 | Sakkab | 252/99 |
| 4,256,598 | 3/1981 | Sakkab | 252/99 |
| 4,311,605 | 1/1982 | Eckhardt et al. | 8/107 |

FOREIGN PATENT DOCUMENTS 1372035 10/1974 United Kingdom .

*Primary Examiner*—A. Lionel Clingman
*Attorney, Agent, or Firm*—Amirali Y. Haidri; James J. Farrell

[57] ABSTRACT

Bleach compositions comprising a weakly coloring to non-coloring porphine photo-activator and process for bleaching substrates or liquids using said porphine photo-activator are disclosed. The porphine photo-activator used and as defined herein is selected such that the lowest energy allowed electronic transition of the photo-activator molecule gives rise to an absorption band (Q band) with maximum intensity at a wavelength greater than 700 nm.

11 Claims, 2 Drawing Figures

BLEACH COMPOSITION CONTAINING WEAKLY TO NON-COLORED PORPHINE PHOTO-ACTIVATOR

Figure 1:
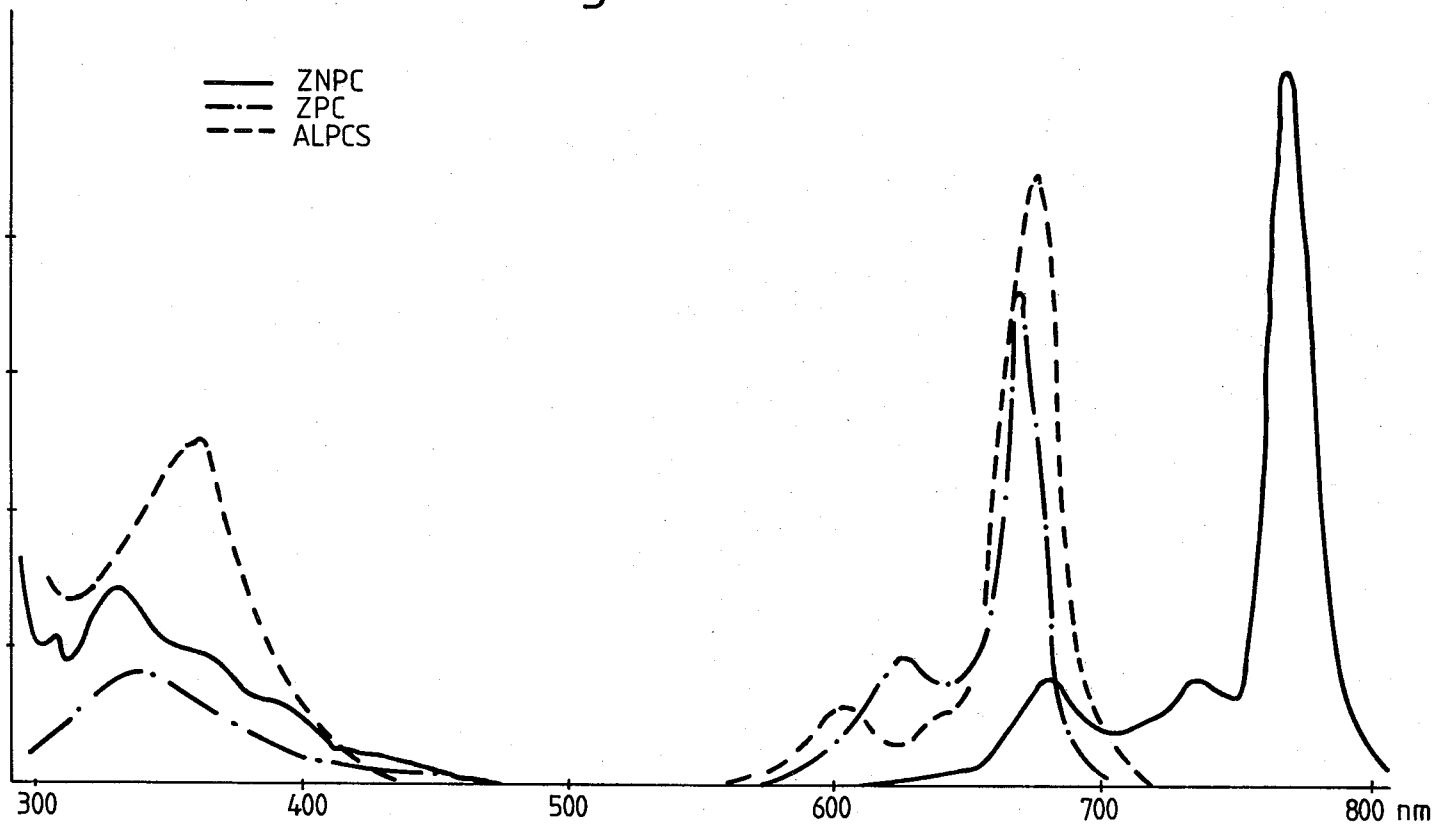

This invention relates to compositions for bleaching and/or disinfecting of organic materials, and to processes for simultaneous removal of stains and fugitive dyes.

U.S. Pat. No. 3,927,967 relates to a washing and bleaching process utilizing photo-activating compounds, principally sulphonated zinc phthalocyanine, in the presence of visible light and atmospheric oxygen. Japanese Patent Application No. OPI 50-73,479 teaches the use of specific mixtures of sulphonated zinc phthalocyanines as preferred bleach photo-activators. In each of the foregoing references the detergent compositions utilizing sulphonated zinc phthalocyanine contained both organic surfactant and alkaline builder salt. U.S. Pat. No. 4,033,718 discloses the use of zinc phthalocyanine tri- and tetrasuphonates as bleach photo-activators in detergent compositions.

U.S. Pat. Nos. 2,951,797, 2,951,798, 2,951,799 and 2,951,800 describe certain porphines as catalysts for the photooxidation of olefins.

References to carboxylated porphines have appeared in U.S. Pat. No. 2,706,199 and C. R. Acad. Sci., Ser. C 1972, 275(11), 573-6 authored by Gaspard et al. See also Color Index No. 74320. References to aminosulphonyl porphines are contained in West-German No. OLS 2,057,194, British Pat. No. 613,781 and British Pat. No. 876,691. See also Color Index No. 74350. Other substituted porphines are disclosed in Austrian Pat. No. 267,711, French Pat. No. 1,267,094, U.S. Pat. No. 2,670,265 and British Pat. No. 471,418.

Porphine photo-activators are further disclosed in European Patent Application Nos. 0.003149, 0.003371 and 0.003861.

Though porphine photo-activators could decolourize various stain chromophores, any such photo-bleaching benefit is generally accompanied by the risk of severe colouring (blueing or greening) of the substrate due to the "direct dye" nature of the porphine compounds. Hence, although very efficient, the porphine compounds so far used as photo-activators, such as the metallated and unmetallated phthalocyanines and sulphonated phtalocyanines, are of limited photo-bleaching effectivness because of the limited level that can be used. For example zinc phthalocyanine tetrasulphonate and aluminium phthalocyanine sulphonate are cellulose substantive materials and at levels above ~0.5 mg/1 (~0.01% on product) produce unacceptable fabric blueing.

Inspection of the UV/visible absorption spectra of many porphine photo-activators, especially phthalocyanines, has shown that these materials have absorptions in the near ultra-violet and the red region separated by an extended transparent region. Thus it was investigated if the effectiveness of this apparently efficient photobleaching process could possibly be improved by shifting the visible absorption into the invisible infra-red regions and so produce a lightly coloured to colourless porphine molecule that could operate as efficiently as the coloured phorphines but that could be used at higher, more effective levels.

The achievement of such a chromophoric shift by molecular refinement requires a knowledge of the electronic transitions in the molecule responsible for both the visible and ultra-violet absorptions. A knowledge of the nature of these transitions would allow variations of the energy associated with these transitions by molecular refinement. The photo-chemical behaviour of this class of compounds must be understood if the resulting molecular refinement is not to result in an unknown change to photo-chemical behaviour.

It has now been found that certain species of porphine photo-activators, of which the lowest energy allowed electronic transition gives rise to an absorption (Q band) with maximum intensity at a wavelength greater than 700 nm, show surprisingly effective photobleaching action in the presence of sunlight, natural or artificial lights having radiation wavelength 600 nm. These photo-activators have the advantage that they form weakly coloured to colourless solutions, so that they can be used at more effective levels without the risk of directly dying the substrate.

Although often containing solubilizing substituents which render these photo-activators water-soluble, hydrophobic application of these materials is also possible without such substitution, e.g. for the bleaching of non-aqueous liquids.

Accordingly the invention provides a bleach composition comprising a weakly colouring to non-colouring porphine photo-activator having the general formula

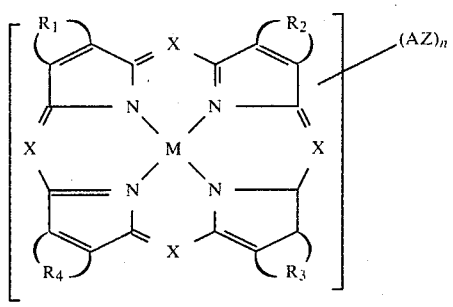

where X is individually (=N—) or (=CY—), the total number of (=N—) groups being at least one; wherein Y is individually hydrogen or optionally substituted alkyl, cycloalkyl, arylalkyl, aryl, alkylaryl or heteroaryl; where each of $R_1$, $R_2$, $R_3$ and $R_4$ is individually an optionally substituted ortho-arylene system forming together with a pyrrole ring in the porphine core a condensed nucleus; wherein M is 2 (H) atoms bound to diagonally opposite nitrogen atoms, or Zn(II), Ca(II), Mg (II), Al(III) or Sn(IV); wherein Z is any necessary counterion for the solubilizing groups; wherein n is the number of solubilizing groups, wherein substituted into Y or any $R_1$, $R_2$, $R_3$ and $R_4$ may be A, a solubilizing group selected from the group consisting of (a) cationic groups, where Z is an anion and n is from 0 to about 10; (b) polyethoxylate nonionic groups $—(CH_2CH_2O)_gH$, where Z is zero, n is from 0 to about 10, and G=(ng)=the number of condensed ethylene oxide molecules per porphine molecule is from 0 to about 70; (c) anionic groups where Z is a cation and n is from 0 to about 10; such that the lowest energy allowed electronic transition of the photo-activator molecule gives rise to an absorption band (Q band) with maximum intensity at a wavelength greater than 700 nm.

In another aspect of the invention a method is provided for bleaching substrates or liquids wherein a porphine photo-activator of the above formula and as defined above is used in the presence of sunlight, natural or artificial lights having radiation wavelength greater than 600 nm.

Preferably each of $R_1$, $R_2$, $R_3$ and $R_4$ is individually an optionally substituted ortho-naphthalene system forming a condensed nucleus together with a pyrrole ring in the porphine core. Preferably X is (=N—).

Normally an absorption with maximum intensity at a wavelength of between 700 and 1200 nm will be suitable in the practice of this invention, but a preferred absorption band maximum will be at a wavelength in the range of 700 to 900 nm.

Preferred cationic solubilizing groups are quaternary pyridinium and quaternary ammonium groups. Preferred anionic solubilizing groups are carboxylate, polyethoxy carboxylate, sulphate, polyethoxy sulphate, phosphate, polyethoxy phosphate, and sulphonate. Preferred nonionic solubilizing groups are polyethoxylates.

The solubilizing groups on a given porphine photoactivator of this invention can be, but need not be, all alike; they can be different not only as to their precise structure but also as to their electrical charge. Thus cationic, anionic, and/or nonionic solubilizing groups can be present on an individual photo-activator molecule.

Preferably the composition of the instant invention contains a surfactant. The surfactant can be anionic, nonionic, cationic, semi-polar, ampholytic, or zwitterionic in nature, or can be mixtures thereof. Surfactants can be used at levels from about 10% to about 50% of the composition by weight, preferably at levels from about 15% to about 30% by weight.

Preferred anionic non-soap surfactants are water-soluble salts of alkyl benzene sulphonate, alkyl sulphate, alkyl polyethoxy ether sulphate, paraffin sulphonate, alphaolefin sulphonate, alpha-sulfocarboxylates and their esters, alkyl glyceryl ether sulphonate, fatty acid monoglyceride sulphates and sulphonates, alkyl phenol polyethoxy ether sulphate, 2-acyloxy-alkane-1-sulphonate, and beta-alkyloxy alkane sulphonate. Soaps are also preferred anionic surfactants.

Especially preferred are alkyl benzene sulphonates with about 9 to about 15 carbon atoms in a linear or branched alkyl chain, more especially about 11 to about 13 carbon atoms; alkyl sulphates with about 8 to about 22 carbon atoms in the alkyl chain, more especially from about 12 to about 18 carbon atoms; alkyl polyethoxy ether sulphates with about 10 to about 18 carbon atoms in the alkyl chain and an average of about 1 to about 12 —$CH_2CH_2O$— groups per molecule, especially about 10 to about 16 carbon atoms in the alkyl chain and an average of about 1 to about 6 —$CH_2CH_2O$-groups per molecule; linear paraffin sulphonates with about 8 to about 24 carbon atoms, more especially from about 14 to about 18 carbon atoms; and alpha-olefin sulphonates with about 10 to about 24 carbon atoms, more especially about 14 to about 16 carbon atoms; and soaps having from 8 to 24, especially 12 to 18 carbon atoms.

Water-solubility can be achieved by using alkali metal, ammonium, or alkanolamine cations; sodium is preferred. Magnesium and calcium are preferred cations under circumstances described by Belgian Pat. No. 843,636. Mixtures of anionic surfactants may be contemplated; a preferred mixture contains alkyl benzene sulphonate having 11 to 13 carbon atoms in the alkyl group and an alkyl polyethoxy alcohol sulphate having 10 to 16 carbon atoms in the alkyl group and an average degree of ethoxylation of 1 to 6.

Preferred nonionic surfactants are water-soluble compounds produced by the condensation of ethylene oxide with a hydrophobic compound such as an alcohol, alkyl phenol, polypropoxy glycol, or polypropoxy ethylene diamine.

Especially preferred polyethoxy alcohols are the condensation product of 1 to 30 moles o ethylene oxide with 1 mole of branched or straight chain, primary or secondary aliphatic alcohol having from about 8 to about 22 carbon atoms; more especially 1 to 6 moles of ethylene oxide condensed with 1 mole of straight or branched chain, primary or secondary aliphatic alcohol having from about 10 to about 16 carbon atoms; certain species of polyethoxy alcohols are commercially available from the Shell Chemical Company under the trademark "Neodol".

Preferred semi-polr surfactants are water-soluble amine oxides containing one alkyl moiety of from about 10 to 28 carbon atoms and 2 moieties selected from the group consisting of alkyl groups and hydroxyalkyl groups containing from 1 to about 3 carbon atoms, and especially alkyl dimethyl amine oxides wherein the alkyl group contains from about 11 to 16 carbon atoms; water-soluble phosphine oxide detergents containing one alkyl moiety of about 10 to about 28 carbon atoms and 2 moieties selected from the group consisting of alkyl groups and hydroxyalkyl groups containing from about 1 to 3 carbon atoms; and water-soluble sulphoxide detergents containing one alkyl moiety of from about 10 to 28 carbon atoms and a moiety selected from the group consisting of alkyl and hydroxy-alkyl moieties of from 1 to 3 carbon atoms.

Preferred ampholytic surfactants are water-soluble derivatives of aliphatic secondary and tertiary amines in which the aliphatic moiety can be straight or branched and wherein one of the aliphatic substituents contains from about 8 to 18 carbon atoms and one contains an anionic water-solubilizing group, e.g. carboxy, sulphonate, sulphate, phosphate, or phosphonate.

Preferred zwitterionic surfactants are water-soluble derivatives of aliphatic quarternary ammonium, phosphonium and sulphonium cationic compounds in which the aliphatic moieites can be straight or branched, and wherein one of the aliphatic substituents contains from about 8 to 18 carbon atoms and one contains an anionic water-solubilizing group, especially alkyl-dimethyl-propanesulphonates and alkyl-dimethyl-ammonio-hydroxy-propanesulphonates wherein the alkyl group in both types contains from about 1 to 18 carbon atoms.

A typical listing of the classes and species of surfactants useful in this invention appear in the books "Surface Active Agents", Vol. I, by Schwartz & Perry (Interscience 1949) and "Surface Active Agents and Detergents", Vol. II by Schwartz, Perry and Berch (Interscience 1958), the disclosures of which are incorporated herein by reference. This listing, and the foregoing recitation of specific surfactant compounds and mixtures which can be used in the instant compositions, are representative but are not intended to be limiting.

The compositions of the present invention can be used for bleaching organic materials, for example fabrics and other textile materials, plastics materials, staple, fibres, wood, paper, oils, fats and orgnic chemicals, and for the disinfection of for example swimming pools, sewage, etc.

Accordingly an essential component of the present invention is a weakly colouring to non-colouring photoactivator as described hereinbefore and further herein-below. This component can also be described as a photo-chemical activator, or as a photo-sensitizer. The photo-activator of the invention is a porphine of the structure:

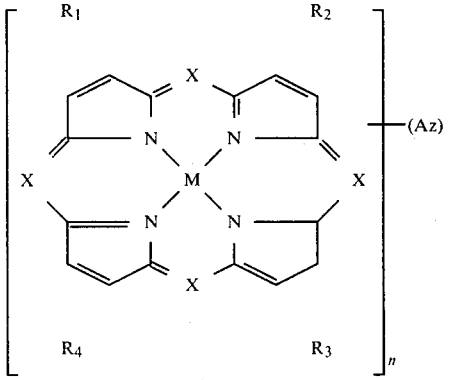

wherein X can be individually (=N—) or (=CY—), the total number of (=N—) groups being at least one; wherein Y can be individually hydrogen or optionally substituted alkyl, cycloalkyl, arylalkyl, aryl, alkylaryl or heteroaryl, wherein each of $R_1$, $R_2$, $R_3$ and $R_4$ can individually be an optionally substituted ortho-arylene system forming together with a pyrrole ring in the porphine core a condensed nucleus; wherein M can be 2(H) atoms bound to diagonally opposite nitrogen atoms, or Zn(II), Ca(II), Mg(II), Al(III) or Sn(IV); wherein Z can be any necessary counterion for the solubilizing groups; wherein n is the number of solubilizing groups; wherein substituted into Y or any of $R_1$, $R_2$, $R_3$ and $R_4$ may be A, a solubilizing group selected from the group consisting of (a) cationic groups, where Z is an anion and n is from 0 to about 10, (b) polyethoxylate nonionic groups $—(CH_2CH_2O)_gH$, where Z is zero, n is from 0 to about 10, and G=(ng)=the number of condensed ethylene oxide molecules per porphine molecule is from 0 to about 70; (c) anionic groups where Z is a cation and n is from 0 about 10; such that the lowest energy allowed electronic transition of the photo-activator molecule gives rise to an absorption band (Q band) with maximum intensity at a wavelength greater than 700 nm.

Preferred photo-activators of the invention are those wherein each of $R_1$, $R_2$, $R_3$ and $R_4$ is individually an optionally substituted ortho-naphthalene system forming a condensed nucleus together with a pyrrole ring of the porphine core. Preferably X is (=N—).

Normally an absorption with maximum intensity at a wavelength of between 700 and 1200 nm will be suitable in the practice of this invention, but a preferred absorption band maximum will be at a wavelength in the range of 700 to 900 nm.

The photo-activating compounds of the invention are substantially non-toxic and can be unmetallized, M in the foregoing structural formula being comprised of two hydrogen atoms bonded to diagonally opposite inner nitrogen atoms of the pyrrole groups in the molecule. Alternatively, the photo-activators can be metallized with zinc(II), calcium(II), magnesium(II), aluminium(III), or tin(IV). Thus altogether, M can be 2(H) atoms bound to diagonally opposite N atoms, or Zn(II), Ca(II), Mg(II), Al(III) or Sn(IV).

Solubilizing groups can be located anywhere on the porphine molecule other than the porphine core as hereinbefore defined. Accordingly the solubilizing groups can be described as substituted into Y or R as hereinbefore defined.

Solubilizing groups can be anionic, nonionic, or cationic in nature. Preferred anionic solubilizing groups are carboxylate

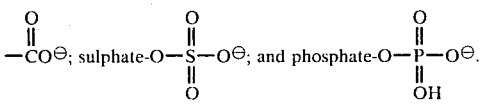

Another preferred anionic solubilizing group is

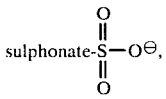

attached to a "remote" carbon atom as hereinafter defined.

Other preferred anionic solubilizing agents are ethoxylated derivatives of the foregoing, especicially the polyethoxysulphate group $—(CH_2CH_2O)_nCOO^-$ where n is an integer from 1 to about 20.

For anionic solubilizing groups, Z the counterion is any cation that confers water-solubility to the porphine molecule. A monovalent cation is preferred, especially ammonium, ethanolammonium, or alkali metal. Sodium is most preferred. For reasons described hereinafter the number of anionic solubilizing groups operable in the compositions of this invention is a function of the location of such groups or the porphine molecule. A solubilizing group attached to a carbon atom of the photoactivator molecular displaced more than 5 atoms away from the porphine cores is sometimes herein referred to as "remote", and is to be distinguished from an attachment to a carbon atom displaced no more than 5 atoms from the porphine core, which is sometimes referred to herein as "proximate". For proximate solubilizing groups, the number of such groups per molecule, n is from 0 to about 10, preferably from 3 to about 6, most preferably 3 or 4. For remote solubilizing groups, n is from 2 to about 8, preferably from 2 to about 6, most preferably 2 to 4. Preferred nonionic solubilizing groups are polyethoxylates $—(CH_2CH_2O)_nH$. Defining n as the number of solubilizing groups per molecule, the number of condensed ethylene oxide molecules per porphine molecule is G=ng.

The water-soluble nonionic photo-activators of this invention have a value of G between about 8 and about 50, preferably from about 12 to about 40, most preferably from about 16 to about 30. Within that limitation the separate values of n and g are not critical.

For nonionic solubilizing groups, there is no counterion and accordingly Z is numerically equal to zero.

Preferred cationic solubilizing groups are quaternary compounds, such as quaternary ammonium salts

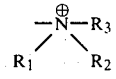

and quaternary pyridium salts

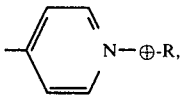

where all R's are alkyl or substituted alkyl groups.

For cationic solubilizing groups, M the counterion is any anion that confers water-solubility to the porphine molecule. A monovalent anion is preferred, especially iodide, bromide, chloride or toluene sulphonate

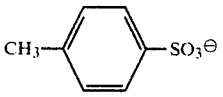

For reasons that are described hereinafter, the number of cationic solubilizing groups can be from 0 to about 10, preferably from about 2 to about 6, most preferably from 2 to 4.

Photo-activator usage in the composition of this invention can be from about 0.001% to about 2.0% by weight of the composition. Preferable usage is from about 0.005% to about 0.1% by weight of the composition. The weight ratio of photo-activator to surfactant, if present, can be between 1/10000 and 1/20, preferably from 1/1000 to 1/100.

Although it is not wished to be bound by theory, it is believed that the mechanism of bleaching using the instant photo-activators involves (1) absorption of dissolved photo-activator on to substrates, e.g. fabrics (2) excitation by light of the photo-activator in its ground-state to the excited singlet state, (3) intersystem crossing to the triplet state which is also excited but at a lower energy level than the singlet state and (4) interaction of the triplet species with the ground state of atmospheric oxygen to form the excited singlet state of oxygen and regenerate the photo-activator in its original ground state.

The excited singlet oxygen is believed to be the oxidative species that is capable of reacting with stains to bleach them to a colourless and usually water-soluble state.

The mechanism above-described is predicated on solubility of the photo-activator in the bath. Solubilization in aqueous media is accomplished by introducing solubilizing groups into the molecule.

However, some care must be taken, especially with anionic solubilizing groups, to ensure that there is no undesirable aggregation of the photo-activator in solution, as then it will become more colouring and/or photo-chemically less active. This aggregation, probably dimerisation, can be prevented through the presence of nonionic or cationic surfactants. It is therefore that the porphine photo-activators of this invention are especially useful in laundry baths, preferably in conjunction with cationic and/or nonionic substances. Inasmuch as cotton surfaces are negatively charged, cationic substances have a strong affinity for cotton fabrics and a strong tendency to adsorb or deposit thereon. In so doing they tend to bring down or co-adsorb other substance present in the laundry bath, such as the photo-activators of this invention.

The porphine photo-activators of this invention may contain in their molecular structure certain chemical groups which solubilize the photo-activator in an aqueous laundry bath. As detailed hereinafter these groups can contain a formal electrical charge, either positive or negative, or can be electrically neutral overall, in which latter case they can contain partial charges of various degrees of strength. A photo-activator molecular can contain more than one solubilizing group, which can be all alike or can be different from one another in respect to electrical charge.

The co-adsorption phenomenon discussed above in relation to cationic substances assumes increasing importance in relation to photo-activators having, to some extent, an anionic or negative charge, whether a negative partial charge, a negative formal charge in an electrically neutral or even cationic molecule as a whole, or a multiplicity of negative charges in an anionic photo-activator molecule.

For anionic photo-activators having proximate solubilizing groups, mono- and di-sulphonated photo-activator molecules are unsatisfactory for laundry use, and hence photo-activators of this invention for use in laundries have three or more proximate solubilizing groups per molecule. Compounds having more than about ten proximate solubilizing groups per molecule are often difficult to make and have no particular advantage. Hence photo-activators of this invention having proximate solubilizing groups for use in laundries have from three to about ten such groups per molecule; compounds having three to six proximate solubilizing groups per molecule are preferred, and compounds having 3 or 4 proximate solubilizing groups per molecule are especially preferred.

The foregoing discussion relates to anionic photo-activators having proximate solubilizing groups. When the solubilizing groups are in remote locations, the tendency of the photo-activator molecule to aggregate is reduced because of both electrostatic and steric reasons, with the result that less dimerization occurs, less build up on the fabric occurs, and the solubilizing effect of individual solubilizing groups is enhanced. Accordingly, a minimum of 2 remotely located anionic solubilizing groups per photo-activator molecule is satisfactory for laundry purposes, with 2 to about 6 being preferred and 3 or 4 being especially preferred.

Nonionic solubilizing groups have a low tendency to aggregate because there is no electrical charge-density effect and there is a particularly large steric effect reducing orderly association between photo-activator molecules. Because solubilization of polyethoxylated photo-activator molecules occurs primarily because of numerous ether groups in the polyethoxylate chains, it is of little consequence whether there is a single very long chain or a number of shorter chains. Accordingly, the solubility requirement as hereinbefore expressed is in terms of the number of condensed ethylene oxide molecules per porphine molecule, which is from about 8 to about 50, preferably from about 12 to about 40, most preferably from about 16 to about 30.

Photo-activators having cationic solubilizing groups do not effectively aggregate at all because the electron density in the ring is reduced. Direct substantivity on cotton fabrics is great. Only one solubilizing group is enough to accomplish the purposes of the invention, although more are acceptable and indeed preferred. Accordingly the limiting numbers of solubilizing cationic groups are from 0 to about 10, preferably from about 2 to about 6, most preferably from 2 to 4.

As stated hereinabove, the macromolecular structure comprising the porphine core contributes the essential photo-activation properties of porphine compounds. It follows inexorably that a large number of compounds having this macromolecular core, but with myriads of different substituent groups, provided that the lowest energy allowed electronic transition of the photo-activator gives rise to an adsorption band (Q band) with maximum intensity at a wavelength greater than 700 nm, are effective in the practice of this invention. One versed in the art will recognize the impracticability of reducing to writing all possibilities that can be envisaged by a skilful practitioner. The embodiments which follow are therefore to be considered exemplary but not exhaustive.

Weakly colouring to non-colouring photo-activators within the scope of this invention are for example:

(i) tetra(sulpho-2,3-naphtho)tetraaza porphine zinc, tetrasodium salt;

(ii) tetra(sulpho-2,3-naphtho)tetraaza porphine aluminium, tetra(monoethanolamine) salt;

(iii) tri(sulpho-2,3-naphtho)mononaphtho-tetraaza porphine, calcium, trisodium salt;

(iv) tetra(2,3-naphtho)tetraaza porphine, zinc;

(v) tetra(4-N-ethylpyridyl-2,3-naphtho)tetraaza porphine, tetrachloride.

Each of the foregoing illustrative photo-activators is a specific chemical compound. Alternative photo-activators, each within the scope of the instant invention, are also those wherein substituted in each specific named compound are, inter alia:

(a) instead of a specific cation listed: sodium, potassium, lithium, ammonium, monoethanolamine, diethanolamine, or triethanolamine salts.

(b) instead of a specific anion listed: chloride, bromide, iodide, or toluene sulphonate salts.

(c) instead of the metallation listed: zinc(II), calcium(II), magnesium(II), aluminium(III), tin(IV), or metal free.

(d) instead of the specific solubilizing group mentioned: carboxylate, polyethoxy carboxylate, sulphate, polyethoxy sulphate, phosphate, polyethoxy phosphate, sulphonate, quaternary pyridinium, quaternary ammonium, or polyethoxylate.

(e) instead of the number of solubilizing groups mentioned: any number of solubilizing groups that is not greater than the number of pyrrole-substituted aromatic or pyrido groups plus the number of meso-substituted aromatic or heterocyclic groups and that is, for cationic or nonionic solubilizing groups, from 0 to 10; for remote anionic solubilizing groups, from 2 to 10; and for nonremote solubilizing groups, from 3 to 10.

The alternative photo-activator compounds described above with Q band absorption maxima at wavelengths greater than 700 nm are to be considered equally illustrative of the compounds of this invention as the compounds specifically named in the preceding list.

The literature contains references to numerous means of preparation of porphine and its derivatives, i.e. to the photo-activators of this invention. One skilled in the art of porphine chemistry will have no difficulty selecting a synthesis appropriate for his particular purposes Some of the synthesis reactions are accompanied by side reactions; in these cases conventional means of separation and purification are needed, such as chromatographic techniques, in a manner also detailed in the literature and well known to the skilled practitioner.

It may be said that there are two general preparative routes to make solubilized substituted porphines. The first route is to prepare the substituted porphine of choice and then solubilize it by introduction of appropriate solubilizing groups. This route is especially applicable to the preparation of sulphonated porphines, and is illustrated hereinafter by the synthesis of diverse individual sulphonated porphine species. The second route is to prepare the solubilized porphine species of choice by using starting materials already containing the desired solubilizing groupts as part of their own constitution. This route is especially applicable to the preparation of porphines solubilized by groups other than sulphonate.

Various principles for preparing porphine photo-activators following these routes are described in European Patent Application No. 0003149, the disclosure of which is incorporated herein by reference.

It will be appreciated that one skilled in the chemical arts, and particularly in the colour and dye arts, can apply the foregoing principles to make his photo-activator of choice according to this invention.

The foregoing description concerns compositions comprising a photo-activator and optionally a surfactant. They are unbuilt compositions. As the photo-activators of this invention are useful in a great variety of otherwise conventional compositions, other optional components may be incorporated.

For instance, conventional alkaline detergent builders, inorganic or organic, can be used at levels up to about 80% by weight of the composition, preferably from 10% to 60%, especially 20% to 40%. The weight ratio of surfactant tot total builder in built compositions can be from 5:1 to 1:5, preferably from 2:1 to 1:2.

Examples of suitable inorganic alkaline detergency builder salts useful in this invention are water-soluble alkali metal carbonates, borates, phosphates, polyphosphates, bicarbonates and silicates. Specific examples of such salts are sodium and potassium tetraborates, perborates, bicarbonates, carbonates, triphosphates, pyrophosphates, orthophosphates, and hexametaphosphates.

Examples of suitable organic alkaline detergency builder salts are: (1) water-soluble aminopolycarboxylates, e.g. sodium and potassium ethylenediaminetetraacetates, nitrolotriacetates and N-(2-hydroxyethyl)-nitrilodiacetates; (2) water-soluble salts of phytic acid, e.g. sodium and potassium phytates (see U.S. Pat. No. 2,739,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid, hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, and propane-1,1,2,3-tetraphosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid and salts of polymers of itaconic acid and maleic acid.

Certain zeolites or aluminosilicates enhance the function of the alkali metal pyrophosphate and add building capacity in that the aluminosilicates sequester calcium hardness. One such aluminosilicate which is useful in the compositions of the invention is an amorphous water-insoluble hydrated compound of the formula $Na_x(x\text{-}AlO_2.SiO_2)$, wherein x is a number from 1.0 to 1.2 and, said amorphous material being further characterized by a $Mg^{++}$ exchange capacity of from about 50 mg eq. $CaCO_3$/g. to about 150 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_z.(SiO_2)_y]xH_2O$ wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium ion exchange rate on an anhydrous basis of at least about 2 grains/gallon/minute/gram. These synthetic aluminosilicates are more fully described in British Pat. No. 1,429,143.

For nominally unbuilt compositions, it is contemplated that such compositions can contain minor amounts, i.e. up to about 10%, of compounds, that, while commonly classified as detergent builders, are used primarily for purposes other than reducing free hardness ions; for example electrolytes used to buffer pH, add ionic strength, control viscosity, prevent gelling, etc.

It is to be understood that the bleach compositions of the present invention can contain other components commonly used in detergent compositions. Soil suspending agents such as water-soluble salts of carboxymethylcellulose, carboxyhydroxymethylcellulose, copolymers of maleic anhydride and vinyl ethers, and polyethylene glycols having a molecular weight of about 400 to 10,000 are common components of the detergent compositions of the present invention and can be used at levels of about 0.5% to about 10% by weight. Dyes, pigments, optical brighteners, perfumes, enzymes, anti-caking agents, suds control agents and fillers can be added in varying amounts as desired.

Peroxygen bleaches such as sodium perborate can optionally be used in the compositions of this invention. In conjunction therewith, conventional organic activators can be used to bleach more effectively at low temperatures, such as the anhydrides, esters and amides disclosed by Allon H. Gilbert in Detergent Age, June 1967, pages 18–20, July 1967, pages 30–33, and August 1967, pages 26–27 and 67. It is generally believed that these activators function by means of a chemical reaction of the activator with the peroxygen compound forming a peroxy acid.

Hence formulations are not precluded that contain components which bleach by two different mechanisms operating independently.

The bleach compositions of the invention can be applied for bleaching substrates, e.g. fabrics; they are also effective photo-bleaches for dye stuffs in solution. Hence the fabric bleach compositions of the invention have the additional advantage that they are also effective in reducing dye transfer in the wash.

Granular formulations embodying the compositions of the present invention may be formed by any of the conventional techniques, i.e. by slurrying the individual components in water and then atomizing and spray-drying the resultant mixture, or by pan or drum granulation of the components. A preferred method of spray-drying compositions in granule form is disclosed in U.S. Pat. Nos. 3,269,951 and 3,629,955 issued to Davis et al. on Dec. 28, 1971.

Liquid detergents embodying the photo-activating compositions of the present invention can contain builders or can be unbuilt. If unbuilt, they can contain about 10 to about 50% surfactant, from 1 to about 15% of an organic base such as mono-, di-, or tri-alkanolamine, and a solubilization system containing various mixtures of water, lower alcohols and glycols, and hydrotropes. Build liquid single-phase compositions can contain about 10 to about 25% surfactant, from about 10 to about 20% builder which can be inorganic or organic, about 3 to about 10% hydrotrope, and water. Built liquid compositions in multiphase heterogeneous form can contain comparable amounts of surfactant and builder together with viscosity modifiers and stabilizers to maintain stable emulsions or suspensions.

The compositions of the present invention can also be prepared in the form of a laundry bar or can be impregnated into a water-insoluble substrate.

Detergent bleach formulations embodying the compositions of the present invention are commonly used in laundry practice at concentrations from about 0.1 to about 0.6 wt.% in water. Within these approximate ranges are variations in typical usage from household to household and from country to country, depending on washing conditions such as the ratio of fabric to water, degree of soiling of the fabrics, temperature and hardness of the water, method of washing whether by hand or by machine, specific formulation employed, etc.

It has been stated hereinbefore that photo-activator usage can be from about 0.001% to about 2.0% by weight based on the bleach composition, preferably from about 0.005% to about 0.1%. Combining these figures with the foregoing detergent bleach concentrations in water yields the results that photo-activator concentrations in water range from about 0.01 part per million (ppm) to about 120 ppm. Within this range, from about 0.05 to about 6 ppm. are preferred. The lower side of the foregoing ranges are especially effective when the laundry process involves exposing fabric to photo-activator for a relatively long time, as for example during a 30 to 120-minute presoak, followed by a 20 to 30-minute wash, and drying the fabric in brilliant sunlight. The higher side of the foregoing ranges are needed when the laundry process involves exposing fabric to photo-activator for a relatively short time, as for example during a short 10-minute wash, followed by drying in an illuminated dryer, on a line indoors, or outdoors on a cloudy day. While exposure to oxygen and light are essential, the source, intensity and duration of exposure of the light affect merely the degree of bleaching achieved.

In all the above conditions photo-bleaching occurs in contrast to the porphine photo-activators of the art, without the risk of undesirable colouring of the substrate.

EXAMPLE 1

The absorption spectra of zinc-2,3naphthalocyanine (ZNPC) of the invention and zinc phthalocyanine (ZPC) in dimethylformamide (DMF) solvent and of aluminium phthalocyanine sulphonate (ALPCS) in water were determined and shown in FIG. 1. The figure shows zinc naphthalocyanine [tetra(2,3-naphtho)-tetraaza porphine, zinc] exhibiting absorption with maximum intensity at a wavelength in the vicinity of 800 nm.

EXAMPLE 2

Figure 2:
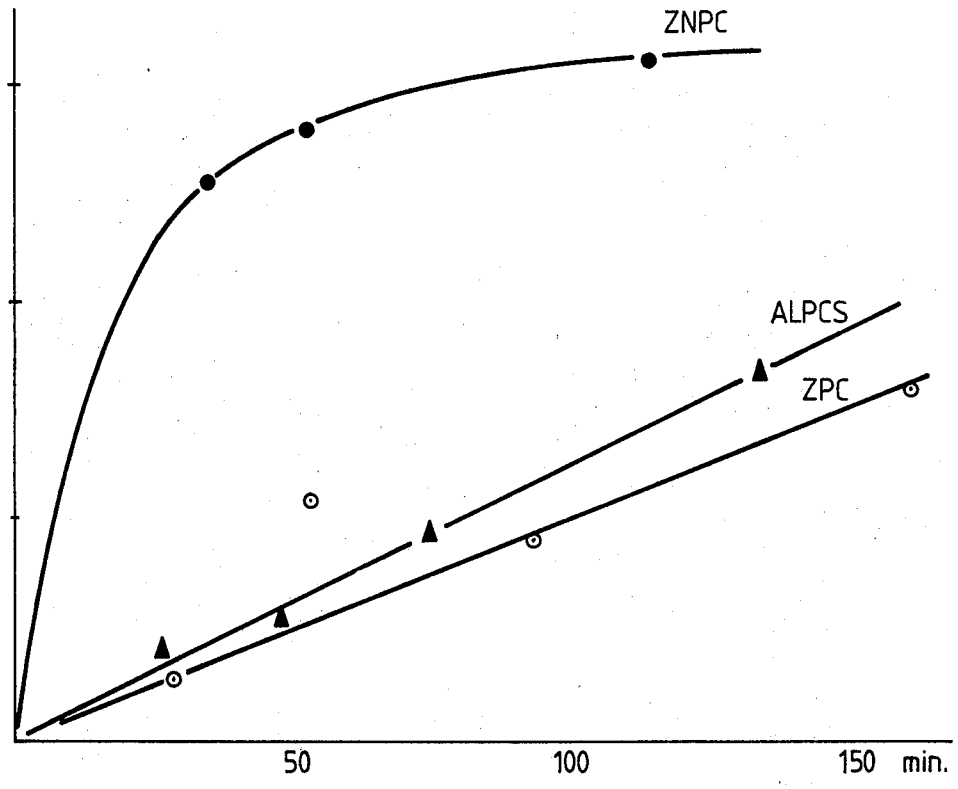

The relative photo-bleaching efficiency on Direct Red 81 of ZNPC of Example 1 was compared with that of ZPC and AlPCS. The results were plotted in FIG. 2 showing DR 81 loss as function of irradiation time. The plots show the rate of loss of Direct Red 81 (DR 81) dye in solution when exposed to radiation from a 450 W Xe lamp filtered through a saturated Rhodamine B solution (Under these conditions—radiation wavelength >600 nm—only the low energy transition of the phthalocyanine compounds are absorbing; the high energy transition and the DR 81 are not excited). From this figure it can be seen that ZNPC of the invention photo-bleaches very much more efficiently than the conventional phthalocyanines.

EXAMPLE 3

Zinc 2,3-naphthalocyanine [tetra(2,3-naphtho)tetraaza porphine, zinc], was prepared in a similar manner to that described in the literature (A. Vogler+H. Kurkley, Inorganica Chimica Acta 1950, 44, L209) reacting naphthalene 2,3-dicarboxylic acid with urea and zinc acetate. The resulting dark green solid was twice extracted in pyridine and vacuum dried. It was shown to have an electronic absorption spectrum, recorded in dimethyl formamide (DMF) solution, using a Perkin Elmer 552, spectrometer with the following characteristics

| Wavelength λ (nm) | 760 | 720 | 678 | 381 (s)* | 333 |
|---|---|---|---|---|---|
| Extinction coef · log · ε | 5.15 | 4.29 | 4.34 | 4.78 | 4.61 |

*(s) = shoulder

The spectrum reported above is similar to that reported by Vogler and Kurkley for zinc 2,3-naphthalocyanine in chloronaphthalene solution. Assuming identical extinction coefficients in chloronaphthalene and DMF, the material prepared above was approx. 88% pure.

Zinc 2,3-naphthalocyanine sulphonate was prepared by adding 1 g of zinc 2,3-naphthalocyanine to 7.5 ml of 5% fuming sulphuric acid and stirring at 117° C. for 3 hours. The reaction mixture was then cooled and carefully poured into ice/water and then neutralised with 40% sodium hydroxide solution to give a green solution which was freeze-dried. The resulting solid was extracted with methanol to give a green solid clearly containing sodium sulphate as impurity. The electronic absorption spectrum of this material recorded in 10% DMF/$H_2O$ solution had the following characteristics

| Wavelength λ (nm) | 763 | 723 | 679 | 333 |
|---|---|---|---|---|
| Extinction coef · log · ε* | 4.99 | 4.16 | 4.19 | 4.45 |

*assuming tetra sulphonation, i.e. [tetra(sulpho-2,3-naphtho)tetraaza porphine, zinc, sodium salt].

EXAMPLE 4

Aluminium 2,3-naphthalocyanine was prepared as follows: 3 g (0.017 moles) of 2,3 dicyanonaphthalene (see preparation method below) was melted (251° C.) and 1 g (0.0075 moles) of anhydrous aluminium chloride added. The mixture was stirred for an hour at 300° C. The reaction mixture was cooled and the dark solid resulting was ground to a fine powder, washed with water and then acetone and dried in a vacuum oven to give a dark green solid (3.2 g). The electronic absorption spectrum of this material recorded in DMF solution had the following absorption maxima

| Wavelength λ (nm) | 767 | 724 | 683 | 336 |
|---|---|---|---|---|
| Extinction coef · log · ε | 5.29 | 4.50 | 4.51 | 4.81 |

The 2,3-dicyano naphthalene used in this preparation was prepared according to a method of Russian Pat. No. 232,963. A solution of 8.4 g (0.02 moles) of W-tetrabromoxylene, 2.3 g (0.03 moles) fumaronitrite and, 18 g (0.12 moles) anhydrous sodium iodide in 50 ml dry DMF was stirred at 75°–80° C. for 6–8 hours. The reaction mixture was cooled and poured into 120 mls. of cold water. The resulting precipitate was filtered, washed with water, vacuum dried and recrystallised from benzene. 3.56 g of 2,3 dicyanonaphthalene was obtained with Mpt 251° C. (literature 251° C.).

Aluminum 2,3 naphthalocyanine sulphonate was prepared by adding 1.0 g ($1,35\times10^{-3}$ mole) of aluminium 2,3-naphthalocyanine to 7.5 mls of 5% fuming sulphuric acid and stirring for 3 hours at 117° C. The reaction mixture was cooled and carefully poured into ice/water and neutralised with 40% sodium hydroxide to give a green coloured solution. This aqueous solution was freeze dried and the resulting solid was extracted with methanol to give 1.63 g of material (clearly containing sodium sulphate as impurity). This material gave the following electronic absorption spectrum maxima when recorded in 10% DMF/$H_2O$ solution

| Wavelength λ (nm) | 767 | 728 | 685 | 340 |
|---|---|---|---|---|
| Extinction coef · log ε* | 4.67 | 3.91 | 3.92 | 4.21 |

*assuming tetrasulphonation, i.e. [tetra(sulpho-2,3-naphtha)tetraaza porphine, aluminium, sodium salt].

EXAMPLE 5

Magnesium-2,3-naphthalocyanine was prepared as follows: 2.04 g of 2,3 dicyanonaphthalene were heated in 70 mls chloronaphthalene and 0.35 g magnesium powder added when dissolved (the 2,3 dicyanonaphthalene was prepared and purified using methods described in Example 2). The reaction mixture was heated until it began to reflux, by which time the mixture had darkened. Refluxing was continued for about 30 minutes or until the reaction was observed to have gone to completion.

The mixture was allowed to cool and was filtered on microcrystalline paper. The residue was dried in a vacuum oven at 80° C. while the filtrate, although containing some magnesium 2,3-naphthalocyanine was discarded. 1.731 g of product was thus obtained (theoretical full conversion yield=2.106 g).

The absorption spectrum of magnesium-2,3-naphthalocyanine recorded in DMF exhibited the following maxima

| Wavelength λ (nm) | 755 | 719 | 674 |
|---|---|---|---|
| Extinction coef · log · ε | 5.11 | 4.38 | 4.36 |

EXAMPLE 6

Metal free-2,3 naphthalocyanine was prepared as follows: 0.5 g of magnesium 2,3-naphthalocyanine was dissolved in 38 ml of 98% sulphuric acid and left to stand at room temperature for 15 minutes. It was then filtered on to ice using a vacuum and a 3 sintered glass funnel. The brown precipitate was washed with 20 ml of 98% sulphuric acid. Dilution of the acid solution to 500 ml reprecipitated the brown material which was filtered, using a 4 sinter and the precipitate was washed with water and ethanol. It was then vacuum dried at 90° C. 0.162 g of material were obtained which in chloronophthalene exhibited electronic absorption maxima at 784, 745 and 696 nm.

EXAMPLE 7

Bleaching of the fugitive dye Direct Fast Red 5B (DR 81)

The bleaching of the fugitive dye Direct Fast Red 5B has been used as a model system for the simulation of dyetransfer inhibition effectiveness and for the bleaching of such species on fabric surfaces. This direct dye is similar in chemical structure to many direct dyes used in the textile and dyeing industries and is a highly suitable model system due to its exceptional light fastness.

(a) In Table 1 below can be seen results of the comparison of the bleaching efficiency of Direct Fast Red 5B using zinc phthalocyanine (ZPC), zinc-2,3-naphthalocyanine (ZNPC) and aluminium 2,3-naphthalocyanine (AlNPC). The photosensitizers were dissolved in DMF and were subjected to radiation emitted from a 450 W Xenon lamp filtered either through (a) a pyrex-/$H_2O$ filter (the transmitted radiation reasonably simulating solar radiation) or (b) an aqueous Rhodamin B solution, allowing only radiation of >600 nm to be transmitted. The three photosensitizers were compared at equal optical densities at their respective visible/uv absorption maxima.

TABLE I

| Photosensitizer | Illumination supplied | Relative Rate of loss of DR 81 |
|---|---|---|
| ZPC | Simulated solar | 34 |
| ZPC | >600 nm | 13 |
| ZNPC | Simulated solar | 368 |
| ZNPC | >600 nm | 116 |
| AlNPC | Simulated solar | 23.4 |
| AlNPC | >600 nm | 9.0 |

It can be clearly seen that the two naphthalocyanines tested, that have their Q band maxima >700 nm, photobleach DR 81 and that the rate of bleaching is comparable with ZPC for AlNPC and superior for ZNPC.

(b) In this example of the photo-bleaching efficiency of the porphine systems of this invention, the direct dye Direct Fast Red 5B has again been bleached and the efficiency of its photo-bleaching with AlNPCS, ZNPCS, AlPCS compared in aqueous solution.

The photosensitizers whose photo-bleaching has been compared were again all employed at concentrations resulting in identical optical densities at their respective Q band absorption maxima.

As in Example 1 (a) radiation was supplied from a 450W Xenon lamp filtered either through a pyrex/water system or a Rodamin B solution.

Again it is clear that the examples of this invention photo-bleach DR 81 in aqueous solution at least as efficiently as a phthalocyanine whose Q band absorption maximum in the visible region of the electromagnetic spectrum results in a high degree of colouration.

TABLE II

| Photosensitizer | Illumination supplied | Relative Rate of loss of DR 81 |
|---|---|---|
| AlPCS* | Simulated solar | 15.5 |
| | >600 nm | 8.8 |
| AlNPCS* | Simulated solar | 15.2 |
| | >600 nm | 12.5 |
| ZNPCS** | Simulated solar | 25.0 |

*solvent = 40% MeOH/$H_2O$.
**aqueous solution in the presence of 5g/l Synperonic 7 (trademark of Imperial Chemical Industries PLC) nonionic surfactant.

EXAMPLE 8

When bleaching experiments were made on direct dye Acrinol Yellow TC 180, the results were as shown in Table III.

TABLE III

| Photosensitizer | Radiation | Relative Photo-bleaching Efficiency |
|---|---|---|
| AlNPCS | Simulated solar | 87 |
| AlPCS | Simulated solar | 72 |

Solution: 40% methanol/$H_2O$.

Radiation: Simulated solar, supplifed by an Atlas Weatherometer fitted with a 6KW Xenon lamp whose radiation is suitably filtered.

Abbreviations Used

ZPC—zinc phthalocyanine
AlPC—aluminium phthalocyanine
AlPCS—sulphonated aluminium phthalocyanine
ZNPC—zinc 2,3-naphthalocyanine
ZNPCS—sulphonated zinc 2,3-naphthalocyanine
AlNPC—aluminium 2,3-naphthalocyanine
AlNPCS—sulphonated aluminium 2,3-naphthalocyanine
MgNPC—magnesium 2,3-naphthalocyanine
NPC—2,3-naphthalocyanine
DR 81—Direct Fast Red 5B
DMF—dimethyl formamide.

EXAMPLE 9

Suitable bleach compositions for fabrics were formulated from the following fabric washing composition and incorporating therein by dry mixing 0.05% by weight of the zinc-2,3-naphthalocynine sulphonate of Example 3 and 0.05% by weight of the aluminium 2,3-naphthalocyanine sulphonate of Example 4, respectively.

| Composition | % by weight |
|---|---|
| Sodium $C_{12}$ alkyl benzene sulphonate | 14.5 |
| Sodium stearate | 2.5 |
| Norylphenol/10 ethyleneoxide | 3.0 |
| Sodium triphosphate | 16.0 |
| Alkaline sodium silicate | 12.0 |
| Sodium carboxymethylcellulose | 0.5 |
| Sodium toluene sulphonate | 1.5 |
| Sodium sulphate | 30.0 |
| Optical brightener, perfume | 0.5 |
| Water and miscellaneous | 19.5 |

These compositions, when used at about 5 g/l. in wash solutions, showed bleaching performances comparable to zinc- or aluminium phthalocyanine sulphonates, but having the advantage of not colouring the substrate.

I claim:

1. A bleach composition comprising a weakly colouring to non-colouring porphine photo-activator having the general formula:

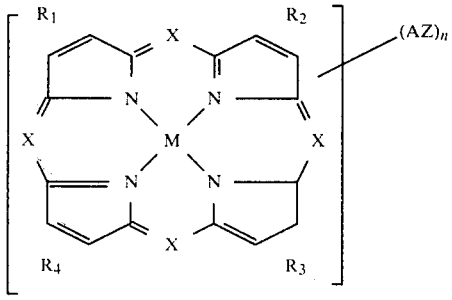

wherein X is (=N—); wherein each of $R_1$, $R_2$, $R_3$ and $R_4$ is individually an optionally substituted ortho-arylene system forming together with a pyrrole ring in the porphine core a condensed nucleus; wherein M is 2(H) atoms bound diagonally opposite nitrogen atoms, or Zn (II), Ca (II), Mg (II), Al (III) or Sn (IV); wherein Z is any necessary counter ion for the solubilizing groups; wherein n is the number of solubilizing groups; wherein substituted into any $R_1$, $R_2$, $R_3$ and $R_4$ may be A, a solubilizing group selected from the group consisting of (a) cationic groups, where Z is an anion and n is from 0 to about 10; (b) polyethoxylate nonionic groups $—(CH_2CH_2O)_gH$, where Z is zero, n is from 0 to about 10, and G=ng=the number of condensed ethylene oxide molecules per porphine molecule is from 0 to about 70 and (c) anionic groups where Z is a cation and n is from 0 to about 10; such that the lowest energy allowed electronic transition of the photo-activator molecule gives rise to an absorption band (Q band) with a maximum intensity; at a wavelength greater than 700 nm.

2. A bleach composition according to claim 1 wherein each of $R_1$, $R_2$, $R_3$ and $R_4$ is individually an optionally substituted ortho-naphthalene system forming a condensed nucleus together with a pyrrole ring in the porphine core.

3. A bleach composition according to claim 1, wherein the absorption band with maximum intensity is at a wavelength in the range of 700–900 nm.

4. A bleach activator according to claim 1, wherein the porphine photo-activator is present in an amount of 0.001% to 2.0% by weight of the composition.

5. A bleach composition according to claim 4, wherein the porphine photo-activator is present in an amount of 0.005% to about 0.1% by weight of the composition.

6. A bleach composition according to claim 4, comprising a surfactant.

7. A bleach composition according to claim 6, characterised in that the surfactant comprises a cationic and/or a nonionic surfactant.

8. A bleach composition according to claim 4, comprising:

(i) 10–50% by weight of a surfactant selected from the group consisting of anionic, nonionic, cationic, semi-polar, ampholytic, zwitterionic detergents and mixtures thereof;

(ii) 0–80% by weight of alkaline detergent builder; and (iii) 0.001%-2.0% by weight of said weakly colouring to non-colouring porphine photo-activator.

9. A process for bleaching substrates or liquids comprising contacting said substrates or liquids with a weakly colouring to non-colouring porphine photoactivator of the general formula:

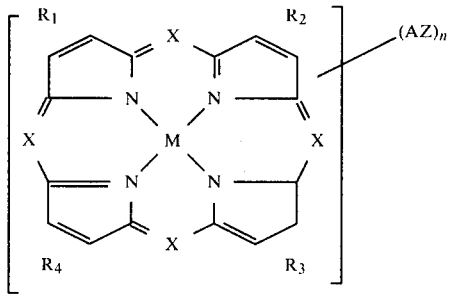

wherein X is (=N—); wherein each of $R_1$, $R_2$, $R_3$ and $R_4$ is individually an optionally substituted orthoarylene system forming together with a pyrrole ring in the porphine core a condensed nucleus; wherein M is 2(H) atoms bound diagonally opposite nitrogen atoms, or Zn (II), Ca (II), Mg (II), Al (III) or Sn (IV); wherein Z is any necessary counter ion for the solubilizing groups; wherein n is the number of solubilizing groups; wherein substituted into any $R_1$, $R_2$, $R_3$ and $R_4$ may be A, a solubilizing group selected from the group consisting of (a) cationic groups, where Z is an anion and n is from 0 to about 10; (b) polyethoxylate nonionic groups $—(CH_2CH_2O)gH$, where Z is zero, n is from 0 to about 10, and G=ng=the number of condensed ethylene oxide molecules per porphine molecule is from 0 to about 70 and (c) anionic groups where Z is a cation and n is from 0 to about 10; such that the lowest energy allowed electronic transition of the photo-activator molecule gives rise to an absorption band (Q band) with a maximum intensity, at a wavelength greater than 700 nm, is used, said bleaching being carried out in the presence of sunlight, natural or artificial light having radiation wavelength greater than 600 nm.

10. A process according to claim 9, wherein each of $R_1$, $R_2$, $R_3$ and $R_4$ is individually an optionally substituted ortho-naphthalene system forming a condensed nucleus together with a pyrrole ring in the porphine core.

11. A process according to claim 9, wherein the absorption band with maximum intensity is at a wavelength in the range of 700 to 900 nm.

* * * * *